US008474282B2

(12) United States Patent
Hsiao

(10) Patent No.: US 8,474,282 B2
(45) Date of Patent: Jul. 2, 2013

(54) WATER PAN FOR WATER DISCHARGE DEVICE OF REFRIGERATION/AIR-CONDITIONING SYSTEM

(75) Inventor: Yu-Ming Hsiao, Taoyuan (TW)

(73) Assignee: Holimay Corporation, Taoyuan County (TW)

( * ) Notice: Subject to any disclaimer, the term of this patent is extended or adjusted under 35 U.S.C. 154(b) by 376 days.

(21) Appl. No.: 13/030,870

(22) Filed: Feb. 18, 2011

(65) Prior Publication Data

US 2012/0151954 A1 Jun. 21, 2012

(30) Foreign Application Priority Data

Dec. 17, 2010 (TW) ..... 99224575 U

(51) Int. Cl.
*F25D 21/14* (2006.01)

(52) U.S. Cl.
USPC ..... 62/285

(58) Field of Classification Search
USPC ..... 62/272, 285, 288, 289, 291
See application file for complete search history.

(56) References Cited

U.S. PATENT DOCUMENTS 4,687,604 A * 8/1987 Goettl ..... 261/29
4,916,919 A * 4/1990 Kim ..... 62/272
5,113,667 A * 5/1992 Sullivan ..... 62/291
5,904,053 A * 5/1999 Polk et al. ..... 62/285
5,987,909 A * 11/1999 Martin, Sr. ..... 62/291
6,629,430 B2 * 10/2003 Mills et al. ..... 62/457.2
6,718,788 B1 * 4/2004 Shuck ..... 62/291
6,779,357 B1 * 8/2004 Fann ..... 62/285
6,978,909 B2 * 12/2005 Goetzinger et al. ..... 220/571
7,284,388 B2 * 10/2007 Yoshida ..... 62/285
7,334,421 B1 * 2/2008 Cantolino ..... 62/259.1
7,392,663 B2 * 7/2008 Kang et al. ..... 62/285
7,992,405 B2 * 8/2011 Cushen ..... 62/285

* cited by examiner

*Primary Examiner* — Mohammad M Ali
(74) *Attorney, Agent, or Firm* — Muncy, Geissler, Olds & Lowe, PLLC

(57) ABSTRACT

Mounted in a bottom side of a water discharge device of a refrigeration/air-conditioning system for collecting waste water, a vermin-protective, high-strength and high beauty water pan is disclosed to include a bottom portion, and an upright peripheral wall extending along the border of the bottom portion and having at least one overflow port. The upright peripheral wall has a part curved inwards, defining a recessed open chamber, a recessed wall portion that surrounds the recessed open chamber, a bridge wall portion that suspends above the recessed open chamber and has the topmost edge thereof higher than the topmost edge of the recessed wall portion, and a plurality of ribs that are connected between the recessed wall portion and the bridge wall portion and divide the space in between the recessed wall portion and the bridge wall portion into multiple overflow holes that form one overflow port.

5 Claims, 6 Drawing Sheets

WATER PAN FOR WATER DISCHARGE DEVICE OF REFRIGERATION/AIR-CONDITIONING SYSTEM

BACKGROUND OF THE INVENTION

1. Field of the Invention

The present invention relates to a water discharge mechanism for refrigeration/air-conditioning system and more particularly, to a water pan for use in a water discharge device of a refrigeration/air-conditioning system.

2. Description of the Related Art

During running of a refrigeration/air-conditioning system, condensed water or waste water will be produced, this water, hereinafter called as waste water will be directly stored in a water storage device and then poured away, or directly guided to a drainable place (such as bathing room or toilet water tank) for drainage.

To satisfy the aforesaid demand, a kind of water discharge device is created for use in a refrigeration or air-conditioning system for the discharge of continuously generated small amount of waste water. This kind of water discharge device generally comprises a motor and vanes, and is used with a water pan that is provided at the bottom side of the water discharge device. Subject to operation of the motor to rotate the banes, waste water is propelled out of the water pan into a drain pipe for drainage.

However, a conventional water pan for this application does not provide any overflow discharge design. If the motor or the water level sensor in the water pan failed, waste water may be continuously accumulated in the water pan and then flow over the water pan into the inside of the refrigeration or air-conditioning system, causing damage to certain electronic components. An overflow hole may be directly made on the peripheral wall of the water pan for overflow. In this case, vermin may enter the water pan through the overflow hole. If large vermin enter the water pan, the intruding vermin may cause the vanes to stick. Thus, this design is not perfect. Further, directly making a hole on the peripheral wall will affect the structural strength of the water pan and destructs its sense of beauty.

SUMMARY OF THE INVENTION

The present invention has been accomplished under the circumstances in view. It is the main object of the present invention to provide a water pan for use in a water discharge device of a refrigeration/air-conditioning system, which provides an overflow hole for the discharge of collected water before the water pan is in full scale, and has the structural strength of the peripheral wall thereof enhanced.

It is another object of the present invention to provide water pan for use in a water discharge device of a refrigeration/air-conditioning system, which is equipped with an overflow hole that is not visible from the outside and prohibits intrusion of large vermin.

To achieve these and other objects of the present invention, a water pan is mounted in a bottom side of a water discharge device of a refrigeration/air-conditioning system for collecting waste water, having a bottom portion and an upright peripheral wall extending along the border of the bottom portion. The upright peripheral wall has at least one overflow port formed therein. The upright peripheral wall has a part curved inwards, defining a recessed open chamber, a recessed wall portion that surrounds the recessed open chamber, a bridge wall portion that suspends above the recessed open chamber and has the topmost edge thereof higher than the topmost edge of the recessed wall portion, and a plurality of ribs that are connected between the recessed wall portion and the bridge wall portion and divide the space in between the recessed wall portion and the bridge wall portion into multiple overflow holes that form one overflow port. Thus, exception of the function to prevent overflow, the water pan has a high structural strength, causes a sense of beauty and prevents vermin from entering the water pan.

DETAILED DESCRIPTION OF THE INVENTION

Figure 1:
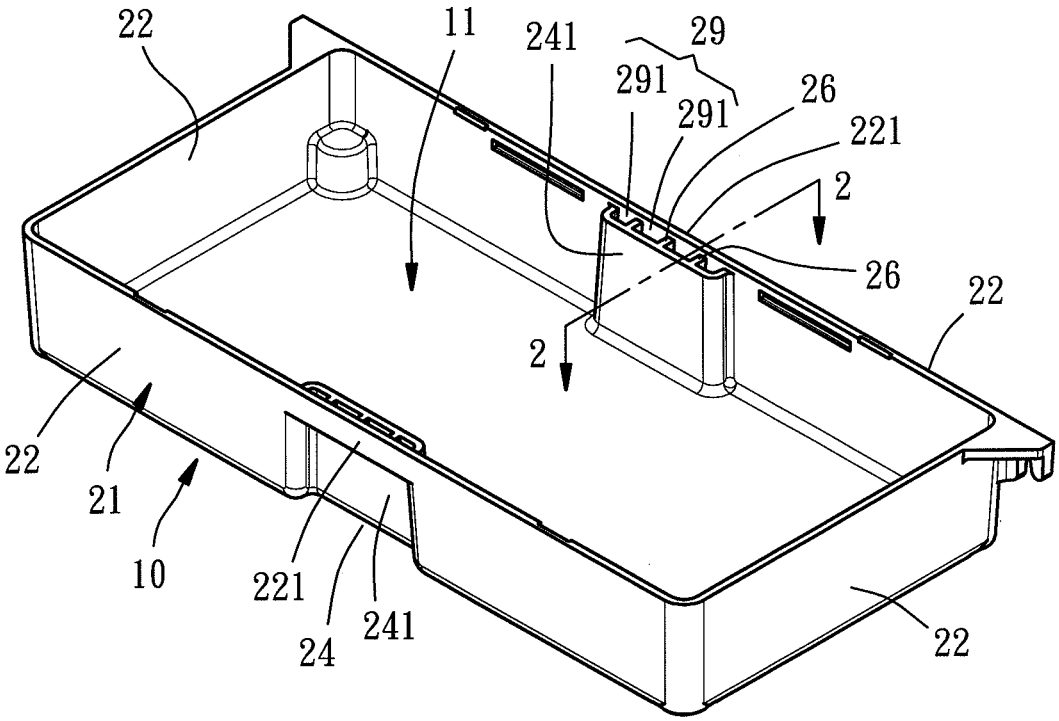
FIG. 1 is an oblique elevational view of a water pan for use in a water discharge device of a refrigeration/air-conditioning system in accordance with the present invention.
Figure 2:
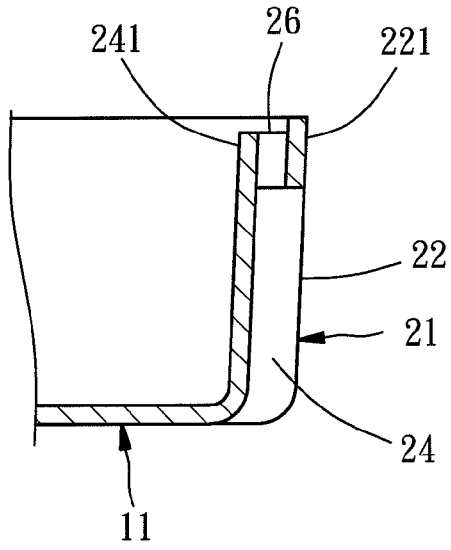
FIG. 2 is a sectional view taken along line 2-2 of FIG. 2.
Figure 3:
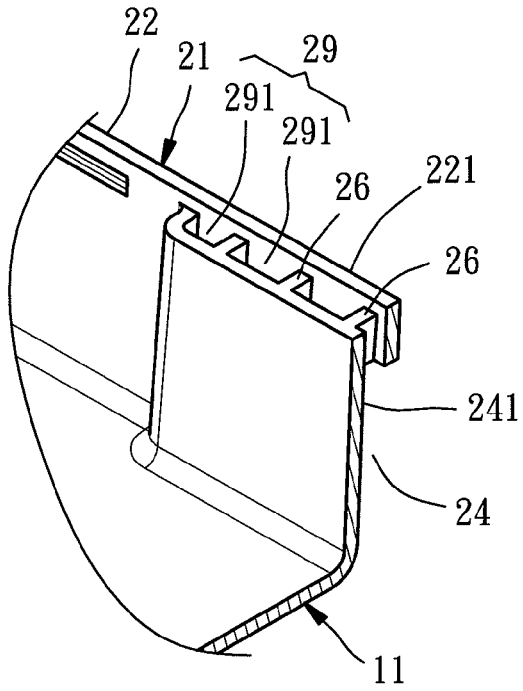
FIG. 3 is a sectional elevation taken along line 2-2 of FIG. 2.
Figure 4:
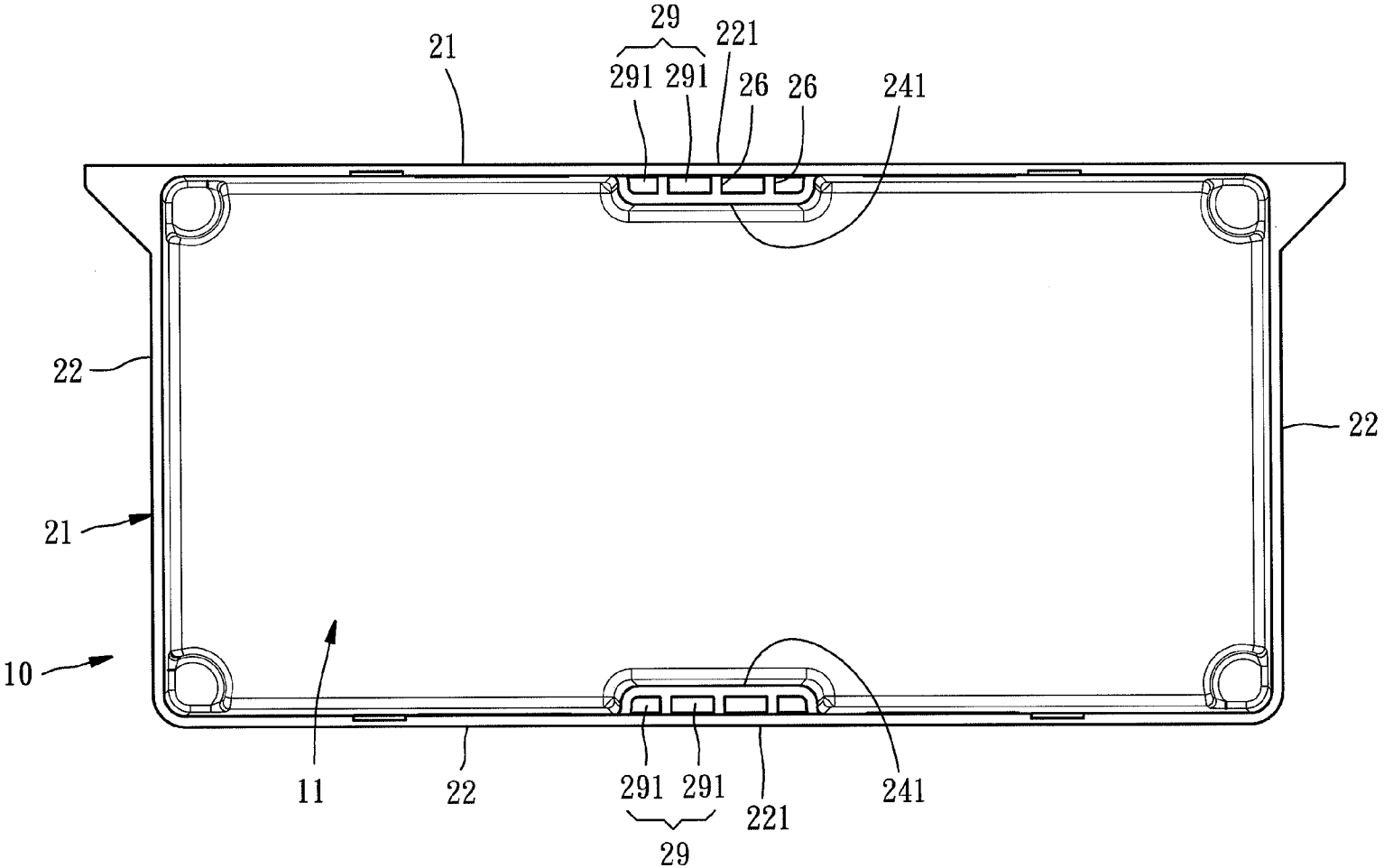
FIG. 4 is a top view of the water pan in accordance with the present invention.
Figure 5:
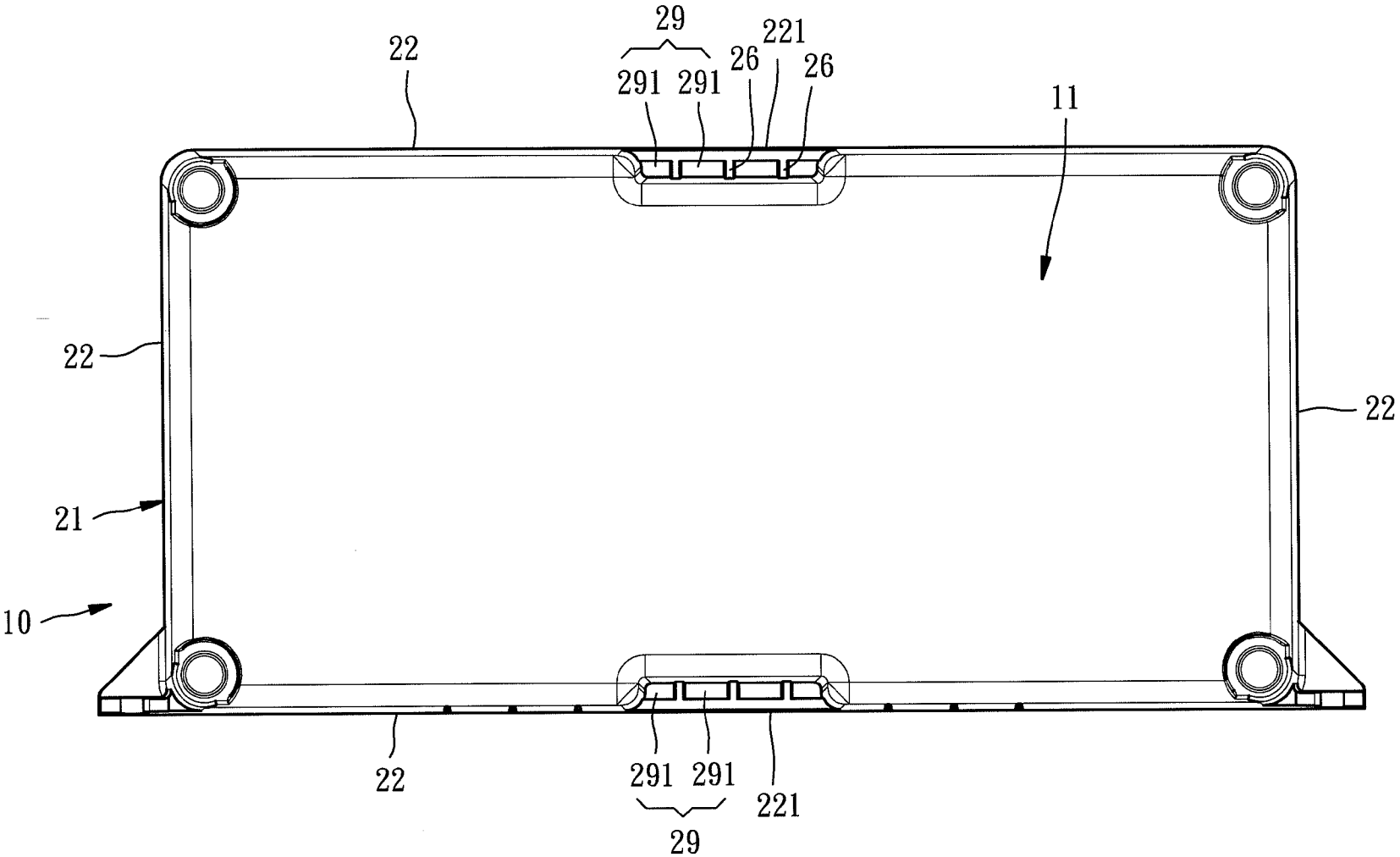
FIG. 5 is a bottom view of the water pan in accordance with the present invention.

The present invention will be fully understood from the following description with reference to the annexed drawings.

Referring to FIGS. 1~5, a water pan 10 in accordance with the present invention is shown disposed at the bottom side of a refrigeration/air-conditioning system's water discharge mechanism 90. The water pan 10 has a bottom portion 11 and an upright peripheral wall 21 extending along the border of the bottom portion 11. According to the present preferred embodiment, the bottom portion 11 has a rectangular shape, and the upright peripheral wall 21 consists of four upright sidewalls 22.

The water pan 10 is characterized in that the upright peripheral wall 21 is provided with two overflow ports 29.

To form one of the aforesaid overflow ports 29, one upright sidewall 22 of the upright peripheral wall 21 has a part curved inwards, defining a recessed open chamber 24, a recessed wall portion 241 that surrounds the recessed open chamber 24 and has the topmost edge thereof disposed below the topmost edge of the upright sidewall 22, a bridge wall portion 221 that suspends above the recessed open chamber 24 and has the topmost edge thereof higher than the topmost edge of the recessed wall portion 241 and a bottom edge lower than the topmost edge of the recessed wall portion 241, and a plurality of ribs 26 that are connected between the recessed wall portion 241 and the bridge wall portion 221 and divide the space in between the recessed wall portion 241 and the bridge wall portion 221 into multiple overflow holes 291 that form one of the aforesaid overflow ports 29. According to the present preferred embodiment, the number of the overflow ports 29 is 2, and these two overflow ports 29 are respectively formed in the two opposite lateral upright sidewalls 22 of the upright peripheral wall 21.

The functioning of the water pan 10 will now be outlined hereinafter with reference to FIGS. 6 and 7.

Figure 6:
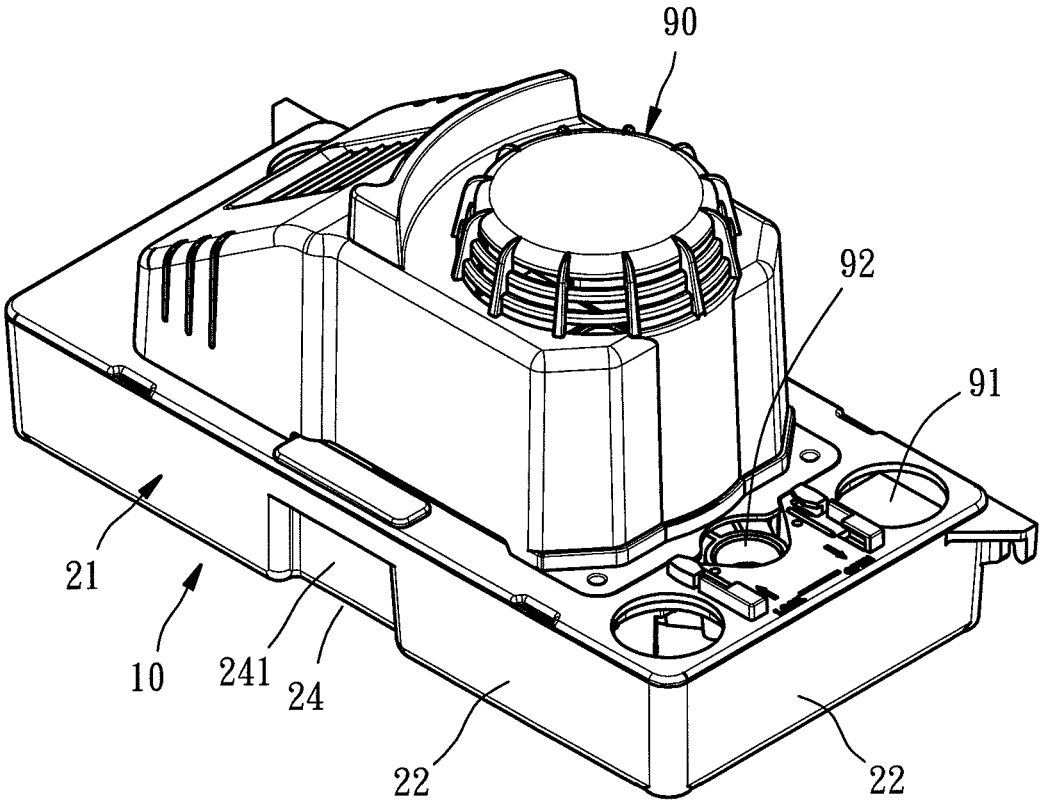
FIG. 6 is an applied view of the present invention, illustrating the water pan set in the bottom side of a water discharge device.
Figure 7:
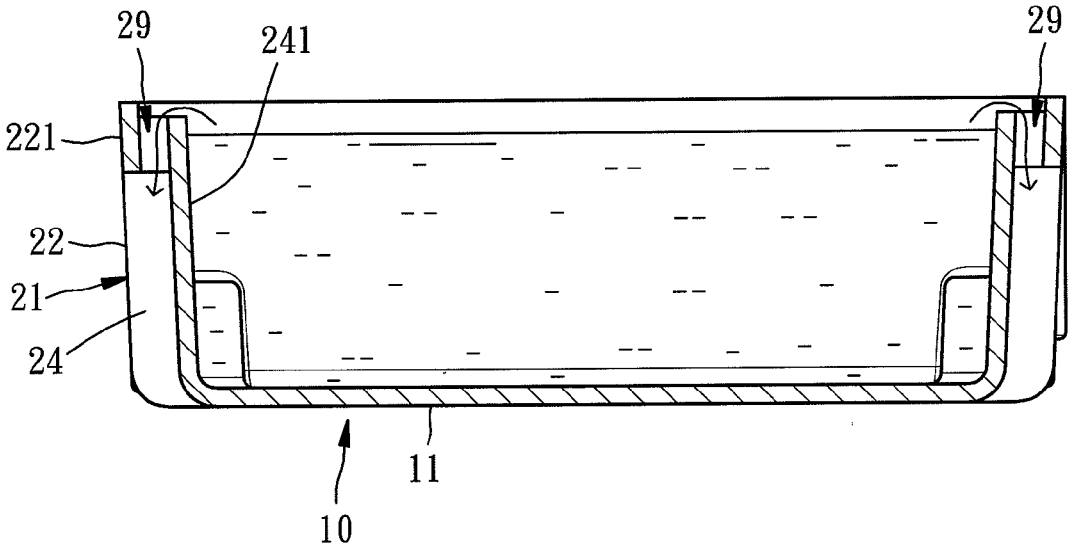
FIG. 7 is a schematic drawing of the present invention, illustrating flowing of water out of the water pan through the overflow ports.

As shown in FIGS. 6 and 7, the water pan 10 is mounted in the bottom side of the refrigeration/air-conditioning system's water discharge mechanism 90 that has a water inlet 91 connected to a drip pipe (not shown) of the air-conditioning (refrigeration) system and a water outlet 92 connected to a drain pipe (not shown) for drainage of water during operation of the motor and vanes (not shown) of the water discharge mechanism 90. When the level of waste water collected in the water pan 10 surpasses the elevation of the topmost edge of the recessed wall portion 241 during operation of the water discharge mechanism 90, waste water will flow over the recessed wall portion 241 out of the water pan 10 through the overflow ports 29 without flowing over the topmost edge of the upright peripheral wall 21 of the water pan 10. Thus, waster water can be discharged before the water pan 10 is in full scale.

As stated above, the invention enables waste water to be discharged before the water pan 10 is in full scale. Further, subject to the design of the elevation difference between the bridge wall portion 221 and the recessed wall portion 241, the overflow ports 29 are not visible from the outside of the water pan 10, and therefore a better sense of beauty is obtained. Further, the bridge wall portion 221 and the recessed wall portion 241 are formed integrally of a part of the respective upright sidewall 22, the peripheral wall of each overflow port 29 has a high structural strength. Further, the design of the overflow ports 29 effectively prohibits large vermin (cockroach, spider) or even mouse from entering the overflow ports 29, achieving the objects of the present invention.

Further, the arrangement of the ribs 26 relatively enhances the structural strength of the peripheral wall of the overflow ports 29 and divides each overflow port 29 into multiple small-sized overflow holes 291 to stop vermin from entering the water pan 10.

In the aforesaid preferred embodiment, the water pan 10 has two overflow ports 29. Alternatively, the water pan 10 can be made having only one single overflow port 29 to achieve the same effects, i.e., the number of the overflow ports 29 can be changed without departing from the spirit and scope of the invention.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A water pan mounted in a bottom side of a water discharge device of a refrigeration/air-conditioning system for collecting waste water, said water pan having a bottom portion and an upright peripheral wall extending along the border of said bottom portion, wherein:

said upright peripheral wall comprises at least one overflow port;

said upright peripheral wall has a part curved inwards, defining a recessed open chamber, a recessed wall portion that surrounds said recessed open chamber and has the topmost edge thereof disposed below the elevation of the topmost edge of said upright peripheral wall, a bridge wall portion that suspends above said recessed open chamber and has the topmost edge thereof higher than the topmost edge of said recessed wall portion, and a space in between said recessed wall portion and said bridge wall portion that forms one said overflow port.

2. The water pan as claimed in claim 1, wherein the topmost edge of said recessed wall portion is higher than the elevation of the bottom edge of said bridge wall portion.

3. The water pan as claimed in claim 2, wherein each said overflow port further comprises a plurality of ribs connected between the associating recessed wall portion and the associating bridge wall portion to divide the space in between the associating recessed wall portion and the associating bridge wall portion into multiple overflow holes.

4. The water pan as claimed in claim 1, wherein said bottom wall has a rectangular shape; said upright peripheral wall consists of four upright sidewalls.

5. The water pan as claimed in claim 1, wherein the number of said at least one overflow port is 2, and these two overflow ports are respective disposed at two opposite lateral sides of said water pan.

* * * * *